US007626393B2

(12) United States Patent
De Jesus et al.

(10) Patent No.: US 7,626,393 B2
(45) Date of Patent: Dec. 1, 2009

(54) APPARATUS AND METHOD FOR MEASURING MOVEMENT OF A DOWNHOLE TOOL

(75) Inventors: Orlando De Jesus, Frisco, TX (US); Pete Dagenais, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 574 days.

(21) Appl. No.: 11/123,425

(22) Filed: May 6, 2005

(65) Prior Publication Data

US 2006/0254768 A1 Nov. 16, 2006

(51) Int. Cl.
*G01V 3/10* (2006.01)

(52) U.S. Cl. ..... 324/333; 324/338; 166/250.04

(58) Field of Classification Search ..... 324/207.19, 324/207.22, 226, 234, 333, 338; 160/250.04, 160/255.1

See application file for complete search history.

(56) References Cited

U.S. PATENT DOCUMENTS 4,292,589 A * 9/1981 Bonner ..... 324/221
5,015,951 A 5/1991 Melcher
5,252,918 A * 10/1993 VanBerg et al. ..... 324/207.19
5,453,689 A 9/1995 Goldfine et al.
5,793,206 A 8/1998 Goldfine et al.
5,904,210 A 5/1999 Stump et al.
6,012,337 A 1/2000 Hodge
6,170,573 B1 1/2001 Brunet et al.
6,364,037 B1 4/2002 Brunnert et al.
6,367,366 B1 4/2002 Bloom et al.
6,433,780 B1 8/2002 Gordon et al.
6,480,119 B1 11/2002 McElhinney
6,648,069 B2 11/2003 Dewey et al.
6,655,460 B2 12/2003 Bailey et al.
6,727,691 B2 4/2004 Goldfine et al.
7,095,223 B2 * 8/2006 Yoo ..... 324/221
2002/0145423 A1 * 10/2002 Yoo ..... 324/221
2004/0100256 A1 * 5/2004 Fickert et al. ..... 324/221

FOREIGN PATENT DOCUMENTS

WO WO 01/22076 A1 3/2001

* cited by examiner

*Primary Examiner*—Reena Aurora
(74) *Attorney, Agent, or Firm*—Lawrence R. Youst

(57) ABSTRACT

An apparatus for detecting movement downhole includes a first downhole component (106) having a sensor (114) coupled thereto and a second downhole component (102) positioned relative to the first downhole component (106). The sensor (114) generates a primary magnetic field that is imposed on the second downhole component (102) thereby generating an induced magnetic field that interacts with the primary magnetic field. Movement of the first downhole component (106) relative to the second downhole component (102) is detected by the sensor (114) by sensing a change in the induced magnetic field.

13 Claims, 5 Drawing Sheets

APPARATUS AND METHOD FOR MEASURING MOVEMENT OF A DOWNHOLE TOOL

TECHNICAL FIELD OF THE INVENTION

This invention relates, in general, to monitoring the location of a downhole tool and, in particular, to an apparatus and method that utilize a sensor coupled to the downhole tool to detect movement of the downhole tool based upon changes in an induced magnetic field.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation.

Conventionally, each section of the casing string is cemented within the wellbore before the next section of the wellbore is drilled. Accordingly, each subsequent section of the wellbore must have a diameter that is smaller than the previous section. For example, a first section of the wellbore may receive a conductor casing string having a 20-inch diameter. The next several sections of the wellbore may receive intermediate casing strings having 16-inch, 13⅜-inch and 9⅝-inch diameters, respectively. The final sections of the wellbore may receive production casing strings having 7-inch and 4½-inch diameters, respectively. Each of the casing strings may be hung from a casinghead near the surface. Alternatively, some of the casing strings may be in the form of liner strings that extend from near the setting depth of previous section of casing. In this case, the liner string will be suspended from the previous section of casing on a liner hanger. Additionally, as should be understood by those skilled in the art, other techniques could be used to construct the wellbore including using a monobore casing design, casing drilling techniques, expandable tubulars or the like.

Once this well construction process is finished, the completion process may begin. For example, the completion process may include creating hydraulic openings or perforations through the production casing string, the cement and a short distance into the desired formation or formations so that production fluids may enter the interior of the wellbore. In addition, the completion process may involve one or more treatment processes such as formation stimulation to enhance production, gravel packing to prevent sand production or the like. The completion process also includes installing a production tubing string within the well that extends from the surface to the production interval or intervals.

Unlike the casing strings that form a part of the wellbore itself, the production tubing string is used to produce the well by providing the conduit for formation fluids to travel from the formation depth to the surface. In addition, tools within the tubing string provide for the control of the fluids being produced from the formation. For example, the production tubing string typically includes one or more seal assemblies. The seal assemblies may be installed above and below each production interval to isolate the production from each interval. Once a seal assembly is properly located within the wellbore, the seal assembly is actuated to create a sealing and gripping relationship with the walls of the adjacent casing or liner. As such, the seal assembly provides a seal in the annular space between the production tubing and the casing to prevent fluid flow and contain pressure.

To achieve the gripping relationship, typical seal assemblies are equipped with anchor slips that have opposed camming surfaces that cooperate with complementary opposed wedging surfaces. The anchor slips are radially extendable into gripping engagement against the well casing bore in response to relative axial movement of the wedging surfaces. To achieve the sealing relationship, typical seal assemblies carry annular seal elements that are expandable radially into sealing engagement against the bore of the well casing in response to an axial compression force. Mechanical or hydraulic means typically may be used to set the anchor slips and the sealing elements. For example, the mechanically set seal assemblies may be actuated by pipe string rotation or reciprocation. Alternatively, mechanically set seal assemblies may be actuated by employing a setting tool that is run downhole and coupled to the seal assembly for setting. Likewise, hydraulically set seal assemblies may be actuated using a setting tool that is run downhole and coupled in fluid communication with the seal assembly. Alternatively, elevating the fluid pressure within the tubing string may be used to actuate hydraulically set seal assemblies.

It has been found, however, that due to the long service life and high pressures operating against seal assemblies, some seal assemblies may move within the wellbore over the course of time. Such movement may be an indication that the seal assembly is about to fail. In addition, it has been found that this movement may be too slow to detect using conventional measurement techniques such as through the use of accelerometers. While accelerometers are useful in detecting fast movements, movement below a certain threshold will go undetected.

Therefore a need has arisen for an apparatus and method for detecting movement of a seal assembly once the seal assembly has been installed within a wellbore and before the seal assembly fails. A need has also arisen for such an apparatus and method that are capable of detecting slow movement of a seal assembly including movement below the threshold detectable by an accelerometer.

SUMMARY OF THE INVENTION

The present invention disclosed herein comprises an apparatus and method for monitoring the location of a downhole tool that may experience movement. The apparatus and method of the present invention are capable of detecting such movement even when the movement is below the threshold detectable by an accelerometer. More specifically, the apparatus and method of the present invention utilize a primary magnetic field generator and an induced magnetic field sensor coupled to the downhole tool to detect movement of the downhole tool relative to other downhole components.

In one aspect, the present invention is directed to an apparatus for detecting movement downhole. The apparatus includes a first downhole component having a sensor coupled thereto that generates a primary magnetic field by, for example, driving an alternating current through a primary winding. A second downhole component is positioned relative to the first downhole component such that the primary magnetic field is imposed on the second downhole component which generates an induced magnetic field that interacts with the primary magnetic field. The sensor detects movement of the first downhole component relative to the second downhole component by sensing a change in the induced magnetic field such as by measuring a change in voltage, current, resistance, impedance, inductive reactance or the like and combinations thereof within the sensor.

The first and second downhole components may be portions of downhole tools, downhole tubulars or the like. For example, the first downhole component may be a seal assembly and the second downhole component may be the well casing. In one embodiment, the second downhole component may include one or more position indicators that enhance the change in the induced magnetic field and thereby enhance the change is the measured parameter within the sensor.

In another aspect, the present invention is directed to method for detecting movement downhole. The method includes the steps of disposing a first downhole component having a sensor coupled thereto relative to a second downhole component, generating a primary magnetic field with the sensor, imposing the primary magnetic field on the second downhole component at a first time, sensing a first response of the second downhole component to the primary magnetic field, imposing the primary magnetic field on the second downhole component at a second time, sensing a second response of the second downhole component to the primary magnetic field and comparing the first response and the second response to detect movement of the first downhole component relative to the second downhole component.

In a further aspect, the present invention is directed to a system for detecting movement downhole. The system includes first and second downhole components positioned relative to one another and a movement detector coupled to the first downhole component. The movement detector includes a primary magnetic field generator, an induced magnetic field sensor and a processor. The primary magnetic field generator generates a primary magnetic field that is imposed on the second downhole component at a first time to generate a first response and at a second time to generate a second response. The induced magnetic field sensor obtains a first measurement relative to the first response and a second measurement relative to the second response. The processor compares the first measurement and the second measurement to detect movement of the first downhole component relative to the second downhole component.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
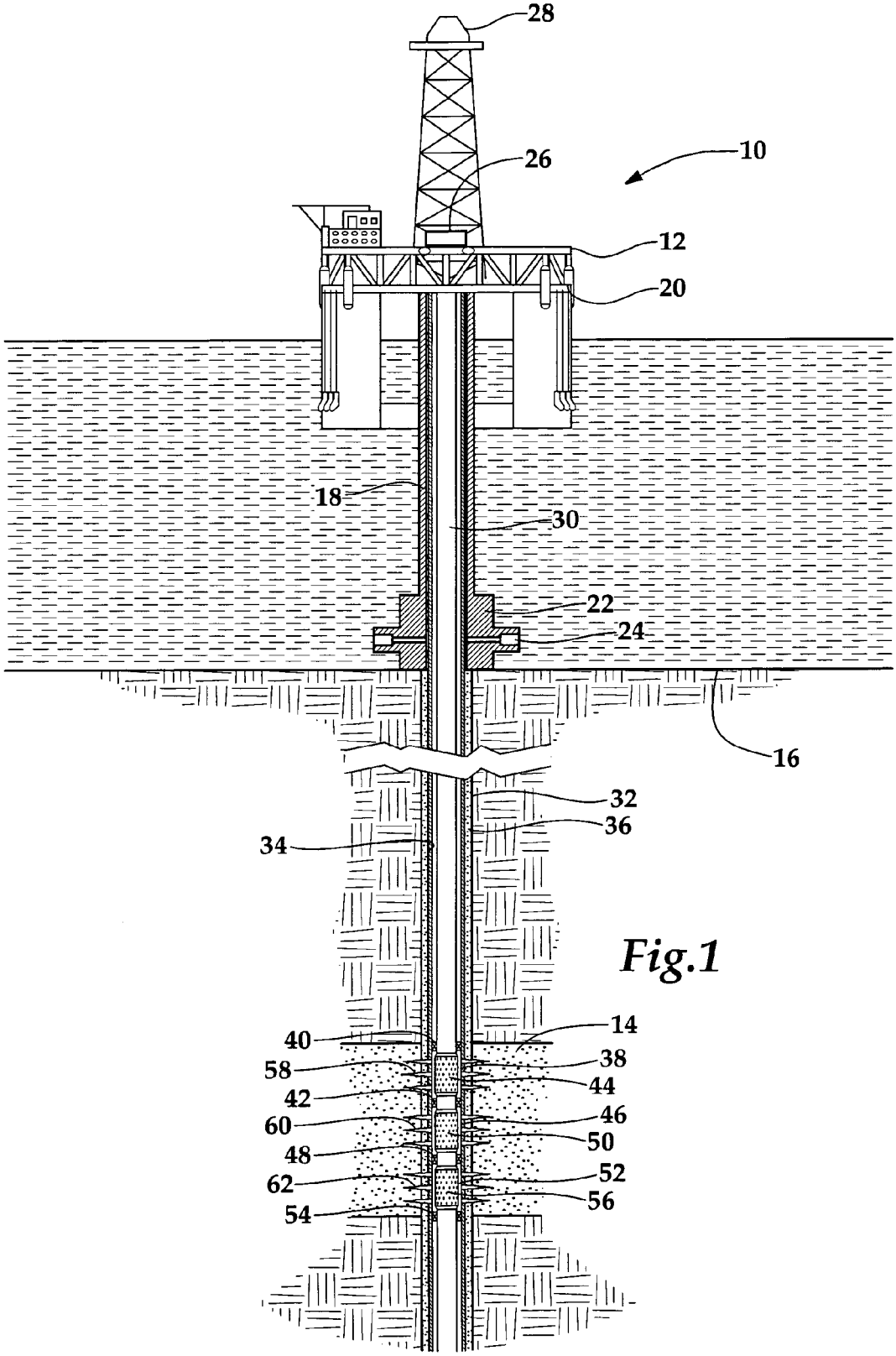
FIG. 1 is a schematic illustration of an offshore oil and gas platform installing a completion system including a system for detecting movement downhole according to the present invention.

Referring initially to FIG. 1, a completion system including a system for detecting movement downhole is being installed from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as production tubing string 30.

A wellbore 32 extends through the various earth strata including formation 14. A casing 34 is cemented within wellbore 32 by cement 36. Production tubing 30 includes various tools such as a plurality of isolation and filtration subassemblies disposed proximate formation 14 dividing formation 14 into a plurality of isolated production zones. As illustrated, production zone 38 is defined by seal assemblies 40, 42 and screen assembly 44, production zone 46 is defined by seal assemblies 42, 48 and screen assembly 50 and production zone 52 is defined by seal assemblies 48, 54 and screen assembly 56. Once production commences from formation 14, fluid may be produced into production zone 38 via perforations 58, into production zone 46 via perforations 60 and into production zone 52 via perforations 62.

As explained in more detail below, the completion system of the present invention is capable of detecting slow movement of one downhole component relative to another downhole component such as one or more of the seal assemblies relative to the casing, the production tubing relative to the casing or other downhole components that may experience movement including slow movement relative to one another.

This result is achieved in the present invention by generating a primary magnetic field with a sensor that is coupled to one of the downhole components. The primary magnetic field is imposed on another downhole component which causes a response in that downhole component including the generation of an induced magnetic field. The sensor senses this response at different points in time, either continuously or intermittently. The sensed responses are then compared to determine whether there has been a change in the induced magnetic field. If there has been a change in the induced magnetic field, this is an indication that the two downhole components have moved relative to one another. In addition, in certain embodiments using multiple readings from an intermittently operated sensor or using a continuously operated sensor, the rate of such movement may be determined.

Figure 2A:
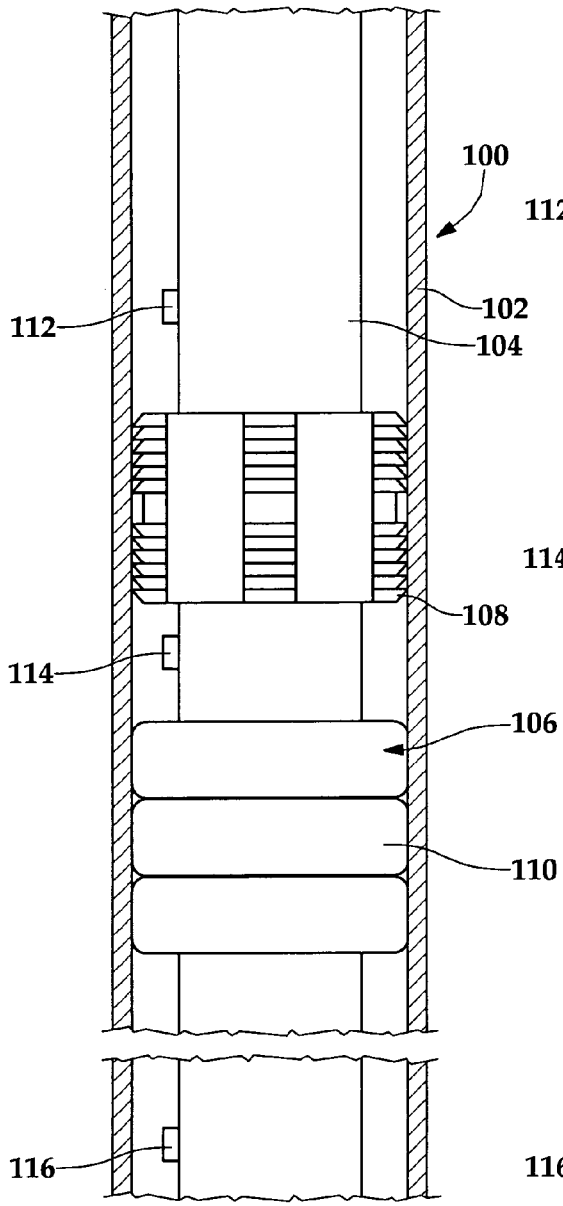
FIGS. 2A-2B are partial cross sectional views of a seal assembly anchored within a casing string incorporating a system for detecting movement downhole according to the present invention.
Figure 2B:
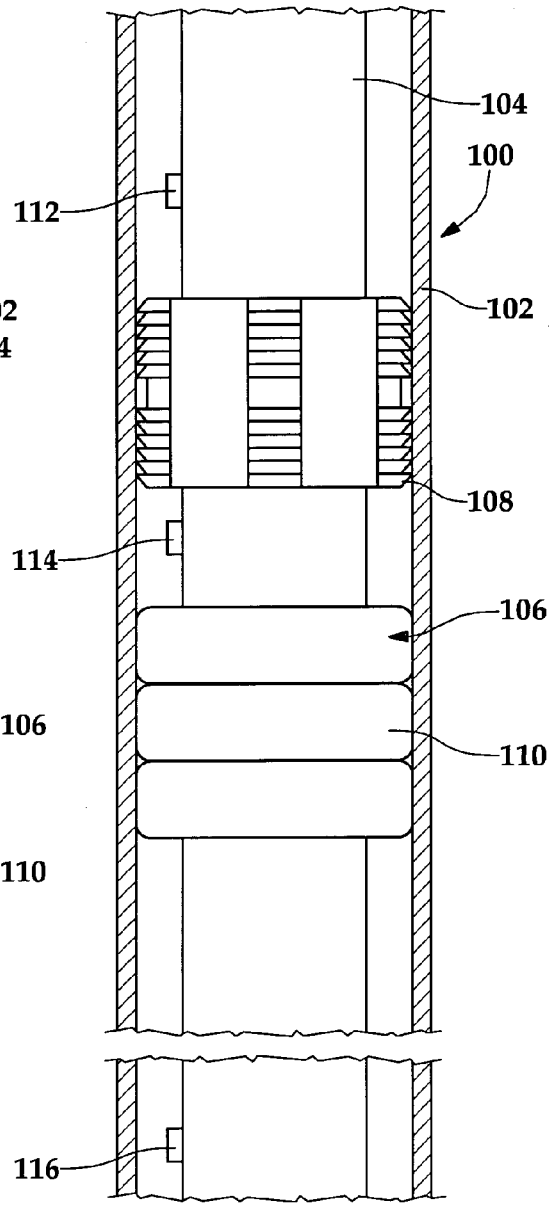

Referring next to FIGS. 2A-2B, therein is depicted a seal assembly anchored within a casing string incorporating a system for detecting slow movement downhole according to the present invention that is generally designated 100. System 100 includes a casing string 102 having positioned therein a production tubing string 104. Positioned within production tubing string 104 is a seal assembly 106. In the illustrated embodiment, seal assembly 106 has been actuated to create a sealing and gripping relationship with the walls of casing string 102 such that fluids and pressure are not allowed to travel thereacross.

As depicted, to achieve the gripping relationship, seal assembly 106 includes anchor slips 108 that are radially extended into gripping engagement against the interior of casing string 102. To achieve the sealing relationship, seal assembly 106 includes annular seal elements 110 that are expanded radially into sealing engagement with the interior of casing string 102. Mechanical or hydraulic means may be used to set anchor slips 108 and sealing elements 110 of seal assembly 106. As state above, due to the long service life and high pressures operating against seal assemblies, some seal assemblies may move within the wellbore over the course of time. As this movement may be too slow to detect using conventional measurement techniques and as this movement may be an indication that the seal assembly is about to fail, the present invention utilizes a plurality of sensors to monitor for such movement.

In the illustrated embodiment, three such sensors are depicted, specifically sensors 112, 114, 116. Sensors 112, 114 are associated with seal assembly 106 while sensor 116 is associated with production tubing 104. Each sensor 112, 114, 116 is surface mounted to using an adhesive or other suitable technique and may be encapsulated within a sealant or other suitable protective material. Each sensor 112, 114, 116 is capable of generating a primary magnetic field by driving an alternating current through a primary winding. Each primary magnetic field is imposed on the adjacent sections of casing string 102. Based upon certain characteristics of casing string 102 at each of the affected locations, each imposed primary magnetic field creates a response in casing string 102 including inducing eddy currents therein that generate an induced magnetic field that interacts with its respective primary magnetic field. Each sensor 112, 114, 116 is also capable of measuring a parameter such voltage, current, resistance, impedance, inductive reactance and combinations thereof that is indicative of the interaction between the induced magnetic field and its respective primary magnetic field.

As long as the frequency of the alternating current, the distance between each sensor 112, 114, 116 and the wall of casing string 102, the surface and near surface characteristics of casing string 102 and other such factors that are known to those skilled in the art remain the same, the parameter measured by each sensor 112, 114, 116 also remains the same. Comparing FIGS. 2B and 2A, however, it can be seen that seal assembly 106 has moved upwardly relative to casing string 102. In this new position, the locations of the imposed primary magnetic field generated by sensors 112, 114 on casing string 102 have changed. As such, the variations in the distance between each sensor 112, 114 and the wall of casing string 102 as well as the surface and near surface characteristics of casing string 102 at the new locations will result in different responses by casing string 102 including different induced magnetic fields that interact with their respective primary magnetic fields. These differences are detected by sensors 112, 114 in the measured parameter. When there is a difference detected in the measure parameter of sensors 112, 114, it can be determined that relative movement has taken place between seal assembly 106 and casing string 102.

In addition, while the locations of the imposed primary magnetic field generated by sensors 112, 114 on casing string 102 has changed, the location of the imposed primary magnetic field generated by sensor 116 has not changed. As such, the value of the measured parameter of sensor 116 will have remained the same thus indicating that relative movement has not taken place between tubing string 104 and casing string 102 at the location adjacent to sensor 116. In this illustrated embodiment, the change in the measured parameter of sensors 112, 114 and the constant value of the measured parameter of sensor 116 indicate that not only has there been relative movement between seal assembly 106 and casing string 102, but there has also been elongation of tubing string 102 at a location between seal assembly 106 and sensor 116. As such, the system 100 of the present invention can provide valuable information regarding the location of a downhole component, the position of one downhole component relative to another downhole component as well as changes in a condition, such as length, of a downhole component.

Even though FIGS. 2A and 2B have described a seal assembly having anchor slips 108 that are radially extended into gripping engagement against the interior of casing string 102 and annular seal elements 110 that are expanded radially into sealing engagement with the interior of casing string 102, the present invention is equal well-suited for use with other types of seal assemblies and other types of downhole tools that could experience movement. For example, the sensors of the present invention may be used with radially expandable seal assemblies and other radially expandable products such as tubing, screens and the like. In such applications, the sensors of the present invention can be used to detect, not only translational and rotational movement, but also, the radial movement taking place during and following the radial expansion process.

Figure 3B:
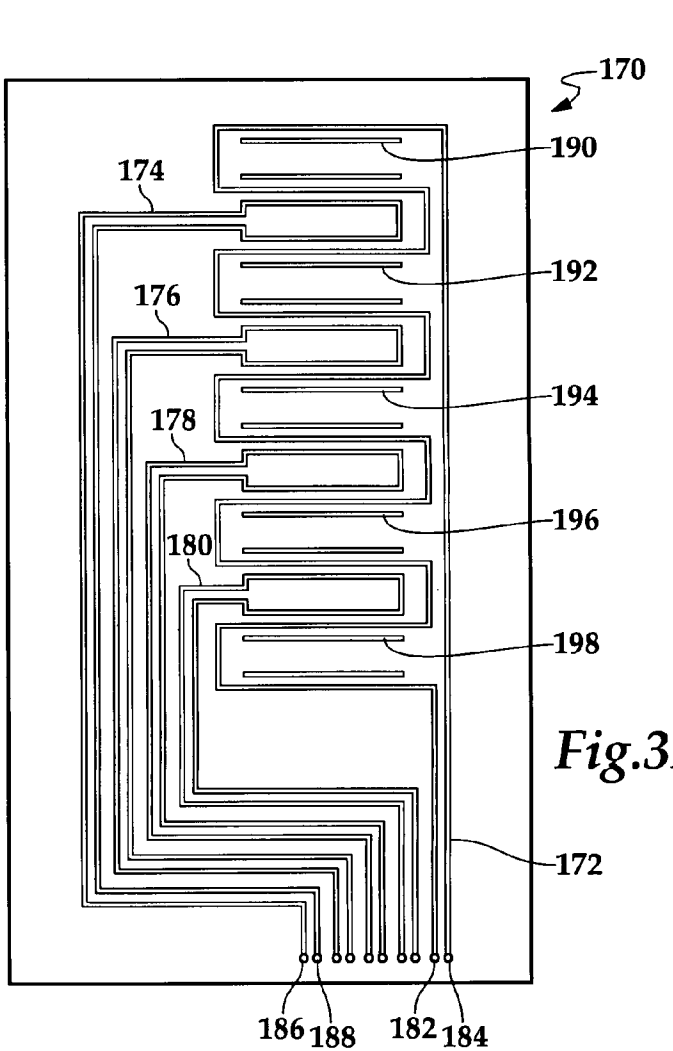
FIGS. 3A-3B are schematic illustrations of circuits for generating a primary magnetic field and sensing an induced magnetic field according to the present invention.
Figure 3A:
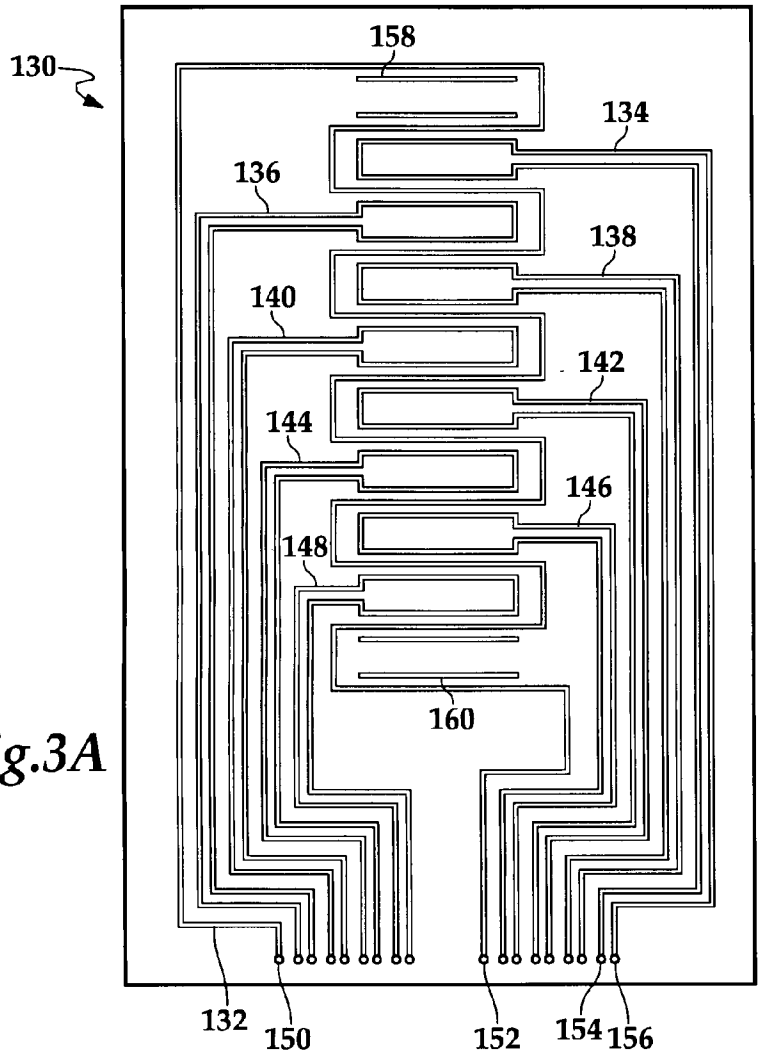

Referring next to FIG. 3A therein is depicted a schematic illustration of a circuit for generating a primary magnetic field and sensing an induced magnetic field according to the present invention that is generally designated 130. Circuit 130 includes a primary winding 132 and an eight element array of secondary winding elements 134, 136, 138, 140, 142, 144, 146, 148. Primary winding 132 has a pair of terminal ends 150, 152 and each of the secondary winding elements has a pair of terminal ends, such as ends 154, 156 of secondary winding element 134. In the illustrated embodiment, circuit 130 includes a pair of dummy elements 158, 160 to maintain symmetry of the primary magnetic field generated by primary winding 132.

Each of the terminal ends primary winding 132 and secondary winding elements 134, 136, 138, 140, 142, 144, 146, 148 is electrically coupled to an impedance analyzer (not pictured) that may be positioned downhole with circuit 130 or may be located at the surface and electrically coupled to circuit 130 via a hard wired connection. The impedance analyzer includes a processor, such as a microprocessor or digital signal processor, and software instructions for operating circuit 130 including analyzing the data obtained from circuit 130. Alternatively, the processor and instructions may be embodied within circuit 130 or may be a discrete component independent of circuit 130 and the impedance analyzer. The impedance analyzer may include a power source, such as a battery, or may be powered via a hard wired connection from the surface, if available. The impedance analyzer drives an input current or voltage into primary winding 132 at a temporal excitation frequency, f, measured in cycles per second where f=T/2 B and where T is the angular frequency of the input electric signal measured in radians per second. Preferably the frequency is between about 60 Hz and 5 MHZ, however, other frequencies may be used depending upon the particular application. This excitation of primary winding 132 produces a time-varying magnetic field at the same frequency, f. The time-varying magnetic field produced by primary winding 132 induces currents in an adjacent conducting material that in turn, produce their own magnetic fields. These induced fields have a magnetic flux in the opposite direction to the fields produced by primary winding 132. As such, the adjacent conducting material will tend to exclude the magnetic flux produced by primary winding 132.

In certain embodiments, the impedance analyzer measures the magnitude and phase of the impedance at terminal ends 150, 152 of primary winding 132, i.e., the measured voltage at terminal ends 150, 152 of primary winding 132 divided by the imposed current. Alternatively or additionally, the impedance analyzer measures the magnitude and phase of the transimpedance, at one or more pairs of terminal ends of secondary winding elements 134, 136, 138, 140, 142, 144, 146, 148, i.e., the voltage measured at the terminal ends of the secondary winding elements divided by the imposed current in the primary winding. In either case, the magnitude and phase of the measured impedance or transimpedance are affected by various properties of the adjacent conducting material, such as the surface configuration of the adjacent conducting material. As should be understood by those skilled in the art, the distribution of the currents induced within the adjacent conducting material and the associated distribution of the magnetic fields in the adjacent conducting material, in the vicinity of the adjacent conducting material and within the conducting primary and secondary windings are governed by the basic laws of physics. Specifically, Ampere's and Faraday's laws combined with Ohm's law and the relevant boundary and continuity conditions result in a mathematical representation of magnetic diffusion in the adjacent conducting material and the Laplacian decay of magnetic fields. As such, based upon computer modeling or through experimental measurements, the magnitude and phase of the measured impedance or transimpedance can be used to determine the location of circuit 130 relative to the adjacent conducting material.

Referring next to FIG. 3B therein is depicted a schematic illustration of another circuit for generating a primary magnetic field and sensing an induced magnetic field according to the present invention that is generally designated 170. Circuit 170 includes a primary winding 172 and a four element array of secondary winding elements 174, 176, 178, 180. Primary winding 172 has a pair of terminal ends 182, 184 and each of the secondary winding elements has a pair of terminal ends, such as ends 186, 188 of secondary winding element 174. In the illustrated embodiment, circuit 170 includes of dummy elements 190, 192, 194, 196, 198 to maintain symmetry of the primary magnetic field generated by primary winding 172.

Each of the terminal ends primary winding 172 and secondary winding elements 174, 176, 178, 180 is electrically coupled to an impedance analyzer (not pictured) that may be positioned downhole with circuit 170 or may be located at the surface and electrically coupled to circuit 170 via a hard wired connection. As stated above, the impedance analyzer drives an input current or voltage though primary winding 172 that produces a time-varying magnetic field at the same frequency. The time-varying magnetic field produced by primary winding 172 induces currents in an adjacent conducting material that in turn, produce their own magnetic fields that have a magnetic flux in the opposite direction to the fields produced by primary winding 172. The impedance analyzer may measure the magnitude and phase of the impedance at terminal ends 182, 184 of primary winding 172 and/or the magnitude and phase of the transimpedance at one or more pairs of terminal ends of secondary winding elements 174, 176, 178, 180. The magnitude and phase of the measured impedance or transimpedances are affected by various properties of the adjacent conducting material, such as the surface configuration of the adjacent conducting material which, based upon computer modeling or through experimental measurements, can be used to determine the location of circuit 170 relative to the adjacent conducting material.

While FIGS. 3A-3B have depicted specific circuits for generating a primary magnetic field and sensing an induced magnetic field, it should be understood by those skilled in the art that other types of eddy-current sensors may be used to detecting movement downhole without departing from the principles of the present invention. For example, such eddy-current sensors may have multiple primary windings, a single secondary winding or no secondary winding. Likewise, such eddy-current sensors may include two-dimensional arrays of secondary winding elements. In addition, such eddy-current sensors may include a plurality of independent circuits, such as circuits 130 and 170 discussed above, each of which generate a primary magnetic field and sense an induced magnetic field. In such multi circuit configurations, each of the circuits may be operated at the same time or may be operated in a particular sequence. Further, the measurement equipment used to determine the effects created by the induced magnetic field may measure parameters other than voltage and current including but not limited to, inductive reactance.

Figure 4:
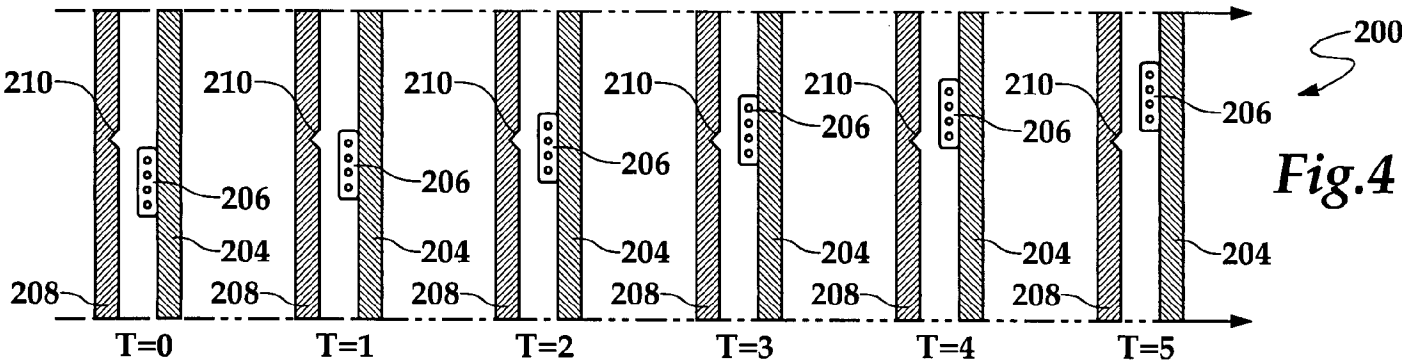
FIG. 4 is a time line depicting translational movement of one downhole component relative to another downhole component wherein one of the downhole components has a circuit for generating a primary magnetic field and sensing an induced magnetic field and the other downhole component has a position indicator according to the present invention.
Figure 5:
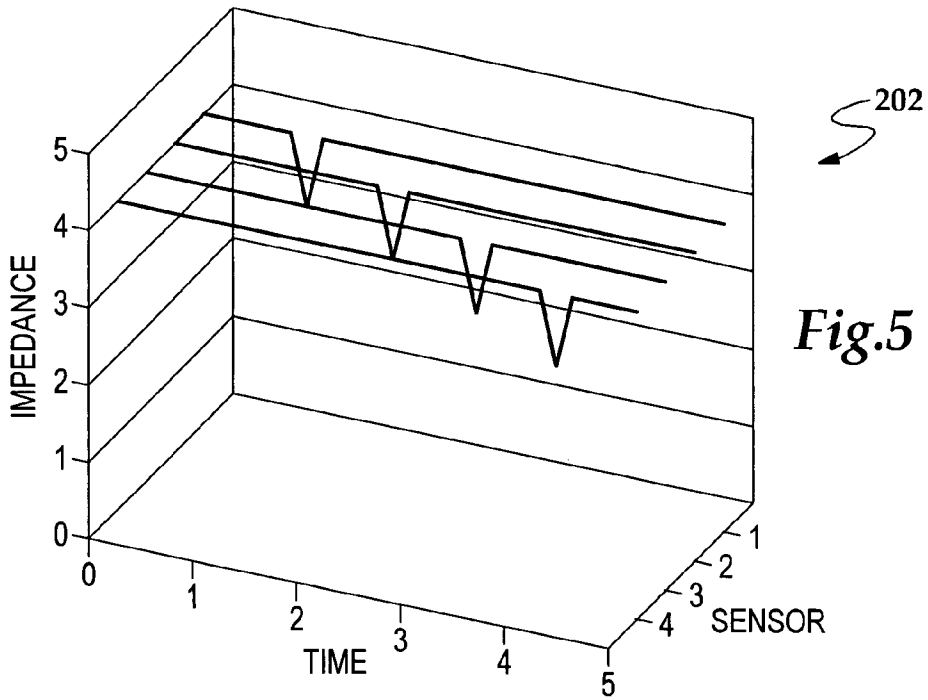
FIG. 5 is a graph illustrating the response of the second downhole component to an imposed primary magnetic field as the first downhole component moves relative to the second downhole component in FIG. 4.

Referring next to FIGS. 4 and 5, therein is depicted a time line 200 showing translational movement of one downhole component relative to another downhole component and a graph 202 illustrating the response of the second downhole component to an imposed primary magnetic field as the first downhole component moves relative to the second downhole. Downhole component 204, such as packer 106 of FIG. 2, has a sensor 206 coupled thereto for generating a primary magnetic field and sensing an induced magnetic field. In the illustrated embodiment, sensor 206 includes a four individual circuit elements each of which could be represented by one of the circuits discussed above with reference to FIG. 3A, FIG. 3B or other suitable eddy-current sensing circuitry. Positioned relative to downhole component 204 is downhole component 208, such as well casing 102 of FIG. 2, that includes a position indicator 210, which is illustrated as an annular notch in the surface of downhole component 208.

At time T=0, each of the circuit elements of sensor 206 is generating a primary magnetic field that induces a response in downhole component 208. At the same time, each of the circuit elements of sensor 206 senses the response as indicated in graph 202. Specifically, each of the circuit elements of sensor 206 is sensing substantially the same response, an impedance of four units, as the distance between each of the circuit elements of sensor 206 and the wall of downhole component 208, the surface and near surface characteristics of downhole component 208 and other such factors that are known to those skilled in the art are substantially the same for each of the circuit elements.

At time T=1, downhole component 204 has moved upwardly relating to downhole component 208. Now, when each of the circuit elements of sensor 206 generates a primary magnetic field that induces a response in downhole component 208 and each of the circuit elements of sensor 206 senses the response, the responses are no longer the same. The induced magnetic field created in response to the primary magnetic field generated by circuit element 1 is affected by position indicator 210. Specifically, as depicted in graph 202, circuit element 1 has an impedance of three units while the remainder of the circuit elements of sensor 206 continue to have an impedance of four units.

At time T=2, downhole component 204 has again moved upwardly relating to downhole component 208 such that circuit element 2 of sensor 206 is adjacent to position indicator 210. As depicted in graph 202, circuit element 2 has an impedance of three units while the remainder of the circuit elements of sensor 206 have an impedance of four units. Likewise at time T=3, when circuit element 3 of sensor 206 is adjacent to position indicator 210, circuit element 3 has an impedance of three units while the remainder of the circuit elements of sensor 206 have an impedance of four units. Additionally at time T=4, when circuit element 4 of sensor 206 is adjacent to position indicator 210, circuit element 4 has an impedance of three units while the remainder of the circuit elements of sensor 206 have an impedance of four units. Finally, at time T=5, when none of the circuit elements of sensor 206 are adjacent to position indicator 210, each of circuit elements of sensor 206 is again sensing substantially the same response, which is depicted as an impedance of four units on graph 202.

Accordingly, the movement of one downhole component relative to another downhole component can be detected using the sensors of the present invention. Specifically, by generating a primary magnetic field with a sensor associated with one downhole component that interrogates another downhole component and sensing the response of the other downhole component with the sensor, changes in the response over time are indicative of such movement. In addition, such changes in the response can be enhanced through the use of position indicators on the interrogated downhole component. Furthermore, the rate of change in position can also be determined using the sensors of the present invention. In the illustrated embodiment, using the distance between the circuit elements and the time elapsed between respective encounters with position indicator 210, the rate of change in position of one downhole component relative to another downhole component can be determined.

Figure 6:
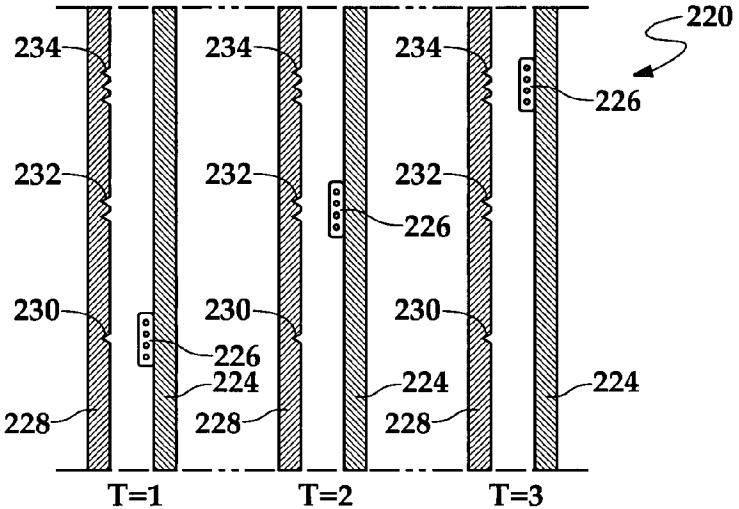
FIG. 6 is a time line depicting translational movement of one downhole component relative to another downhole component wherein one of the downhole components has a circuit for generating a primary magnetic field and sensing an induced magnetic field and the other downhole component has a position indicator according to the present invention.
Figure 7:
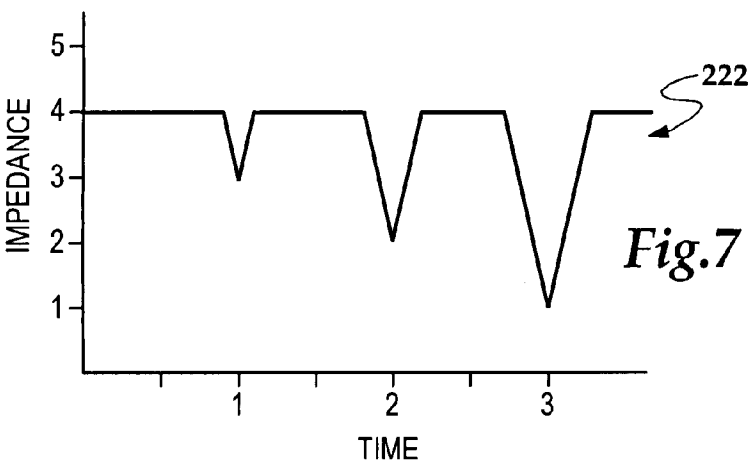
FIG. 7 is a graph illustrating the response of the second downhole component to an imposed primary magnetic field as the first downhole component moves relative to the second downhole component in FIG. 6.

Referring next to FIGS. 6 and 7, therein is depicted a time line 220 showing translational movement of one downhole component relative to another downhole component and a graph 222 illustrating the average response of the second downhole component to an imposed primary magnetic field as the first downhole component moves relative to the second downhole. Downhole component 224 has a sensor 226 coupled thereto for generating a primary magnetic field and sensing an induced magnetic field. In the illustrated embodiment, sensor 226 may include one or more of individual circuit elements each of which could be represented by one of the circuits discussed above with reference to FIG. 3A, FIG. 3B or other suitable eddy-current sensing circuitry. Positioned relative to downhole component 224 is downhole component 228 that includes a series of position indicators 230, 232, 234, which are illustrated as annular notches in the surface of downhole component 228.

At time T=1, sensor 226 is adjacent to position indicator 230. Sensor 226 generates a primary magnetic field that induces a response in downhole component 228 and senses the response of downhole component 228. At this location, as indicated in graph 222, the sensed response is a reduction in the impedance of one unit as compared to the background impedance, when sensor 226 is not adjacent to any position locator. At time T=2, downhole component 224 has moved upwardly relative to downhole component 228 such that sensor 226 is now adjacent to position indicator 232. As depicted in graph 222, the sensed response of downhole component 228 to a primary magnetic field generated by sensor 226 is a reduction in the impedance of two units as compared to the background impedance. Likewise at time T=3, when downhole component 224 has moved upwardly relating to downhole component 228 such that sensor 226 is adjacent to position indicator 234, graph 222 indicates that the sensed response of downhole component 228 to a primary magnetic field generated by sensor 226 is a reduction in the impedance of three units as compared to the background impedance.

Through the use of different types of position indicators at different locations, the movement of one downhole component relative to another downhole component can be monitored in stages to, for example, alert field personnel as to the level of movement of a particular downhole component. In the illustrated embodiment, when sensor 226 encounters position indicator 230 this may cause a first level alert to be sent to the surface. This communication may be sent to the surface via any of the known or later discovered downhole communication systems including, but not limited to, hardwired systems, acoustic systems, electromagnetic systems, pressure pulse systems, wireline interrogation systems or the like. Later, when sensor 226 encounters position indicator 232 this may cause a second level alert to be sent. Still later, when sensor 226 encounters position indicator 234 this may cause a third level alert to be sent. Alternatively or additional, sensor 226 may send a communication directly to another downhole component to cause an operation in that downhole component. For example, sensor 226 may include a microprocessor or microcontroller having instructions associated therewith that may send a command to other downhole components to shut in the well if sensor 226 detects relative movement that exceeds a predetermined threshold, such as when sensor 226 encounters position indicator 234.

Figure 8:
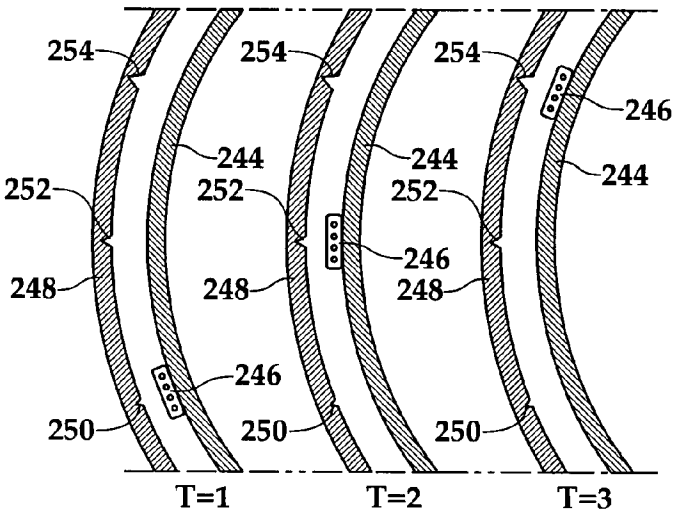
FIG. 8 is a time line depicting rotational movement of one downhole component relative to another downhole component wherein one of the downhole components has a circuit for generating a primary magnetic field and sensing an induced magnetic field and the other downhole component has a position indicator according to the present invention.
Figure 9:
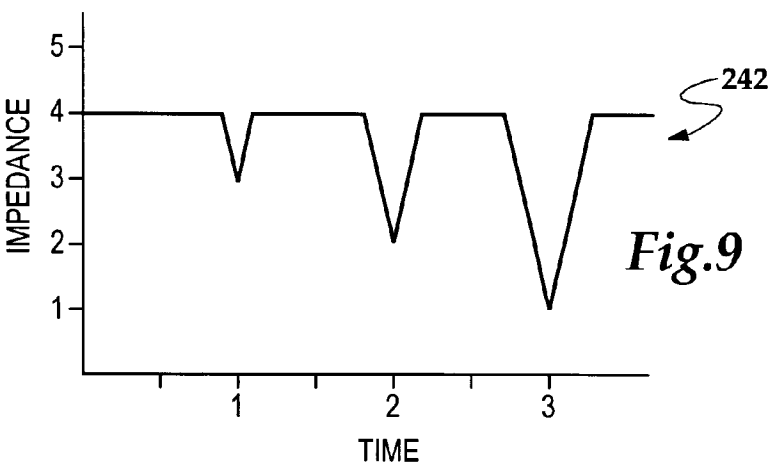
FIG. 9 is a graph illustrating the response of the second downhole component to an imposed primary magnetic field as the first downhole component moves relative to the second downhole component in FIG. 8.

Referring next to FIGS. 8 and 9, therein is depicted a time line 240 showing rotational movement of one downhole component relative to another downhole component and a graph 242 illustrating the average response of the second downhole component to an imposed primary magnetic field as the first downhole component moves relative to the second downhole. Downhole component 244 has a sensor 246 coupled thereto for generating the primary magnetic field and sensing an induced magnetic field. In the illustrated embodiment, sensor 246 may include one or more individual circuit elements each of which could be represented by one of the circuits discussed above with reference to FIG. 3A, FIG. 3B or other suitable eddy-current sensing circuitry. Positioned relative to downhole component 244 is downhole component 248 that includes a series of position indicators 250, 252, 254, which are illustrated as longitudinal notches in the surface of downhole component 248.

At time T=1, sensor 246 is adjacent to position indicator 250. Sensor 246 generates a primary magnetic field that induces a response in downhole component 248 and senses the response of downhole component 248. At this location, as indicated in graph 242, the sensed response is a reduction in the impedance of one unit as compared to the background impedance, when sensor 246 is not adjacent to any position locator. At time T=2, downhole component 244 has rotated relative to downhole component 248 such that sensor 246 is now adjacent to position indicator 252. As depicted in graph 242, the sensed response of downhole component 248 to a primary magnetic field generated by sensor 246 is a reduction in the impedance of two units as compared to the background impedance. Likewise at time T=3, when downhole component 244 has rotated relative to downhole component 248 such that sensor 246 is adjacent to position indicator 254, graph 242 indicates that the sensed response of downhole component 248 to a primary magnetic field generated by sensor 246 is a reduction in the impedance of three units as compared to the background impedance.

Accordingly, a variety of types of movement of one downhole component relative to another downhole component can be monitored using the sensors of the present invention. As depicted above, rotational movement of one downhole component relative to another downhole component can be monitored as can the level of such rotation movement through the use of position indicators including, for example, sequentially dissimilar position indicators. In addition, as depicted above, translational movement of one downhole component relative to another downhole component can be monitored including monitoring for elongation or contraction of tubular goods. Further, radial expansion or contraction of such tubular goods could also be monitored using the sensors of the present invention as a change in the distance between the downhole component having the sensor and the adjacent downhole component will cause a change in the response to the primary magnetic field. Also, it should be understood by those skilled in the art that the sensors of the present invention are capable of identifying changes in relative position without the use of position indicators. For example, in a continuously operating sensor system, changes in the saturation level of the interrogated downhole component can be detected by the circuit components on the leading edge of the sensor as the movement occurs.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for detecting movement downhole comprising:

a first downhole component having a sensor coupled thereto, the sensor including a primary winding and a plurality of secondary winding elements, the sensor generating a time varying primary magnetic field in response to excitation of the primary winding; and a second downhole component positioned relative to the first downhole component such that the primary magnetic field is imposed on the second downhole component which generates an induced magnetic field that interacts with the primary magnetic field;

wherein movement of the first downhole component relative to the second downhole component is detected by the sensor by sensing a change in the induced magnetic field by measuring one of the impedance at terminal ends of the primary winding and the transimpedance at terminal ends of at least one of the secondary winding elements.

2. The apparatus for detecting movement downhole as recited in claim 1 wherein the first downhole component is a downhole tool.

3. The apparatus for detecting movement downhole as recited in claim 1 wherein the first downhole component is a downhole tubular.

4. The apparatus for detecting movement downhole as recited in claim 1 wherein the first downhole component is a seal assembly and the second downhole component is a tubular.

5. The apparatus for detecting movement downhole as recited in claim 1 wherein the second downhole component further comprises a position indicator.

6. The apparatus for detecting movement downhole as recited in claim 1 wherein the time varying primary magnetic field is generated by driving an alternating current through the primary winding.

7. A method for detecting movement downhole comprising:

disposing a first downhole component having a sensor coupled thereto relative to a second downhole component, the sensor including a primary winding and a plurality of secondary winding elements;

generating a time varying primary magnetic field with the sensor in response to excitation of the primary winding;

at a first time, imposing the primary magnetic field on the second downhole component which generates a first response in the form of a first induced magnetic field that interacts with the primary magnetic field;

sensing the first response by measuring one of the impedance at terminal ends of the primary winding and the transimpedance at terminal ends of at least one of the secondary winding elements;

at a second time, imposing the primary magnetic field on the second downhole component which generates a second response in the form of a second induced magnetic field that interacts with the primary magnetic field;

sensing the second response by measuring one of the impedance at terminal ends of the primary winding and the transimpedance at terminal ends of at least one of the secondary winding elements; and comparing the first response and the second response to detect movement of the first downhole component relative to the second downhole component.

8. The method for detecting movement downhole as recited in claim 7 wherein the step of generating a time varying primary magnetic field with the sensor further comprises driving an alternating current through the primary winding in the sensor.

9. The method for detecting movement downhole as recited in claim 7 wherein the steps of imposing the primary magnetic field on the second downhole component further comprise inducing eddy currents in the second downhole component that generate the induced magnetic fields.

10. The method for detecting movement downhole as recited in claim 7 wherein the steps of sensing responses of the second downhole component to the primary magnetic field further comprise sensing an interaction between an induced magnetic field and the primary magnetic field.

11. The method for detecting movement downhole as recited in claim 7 wherein the step of comparing the first response and the second response to detect movement of the first downhole component relative to the second downhole component further comprises detecting movement of the first downhole component relative to a position indicator of the second downhole component.

12. The method for detecting movement downhole as recited in claim 7 wherein the step of comparing the first response and the second response to detect movement of the first downhole component relative to the second downhole component further comprises detecting at least one of translational movement and rotational movement of the first downhole component relative to the second downhole component.

13. The method for detecting movement downhole as recited in claim 7 further comprising the step of determining a rate of change of position of the first downhole component relative to the second downhole component.

* * * * *

UNITED STATES PATENT AND TRADEMARK OFFICE

CERTIFICATE OF CORRECTION

PATENT NO. : 7,626,393 B2
APPLICATION NO. : 11/123425
DATED : December 1, 2009
INVENTOR(S) : De Jesus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 909 days.

Signed and Sealed this

Second Day of November, 2010

David J. Kappos

David J. Kappos
*Director of the United States Patent and Trademark Office*